US009545732B2

(12) United States Patent
Koshio et al.

(10) Patent No.: US 9,545,732 B2
(45) Date of Patent: Jan. 17, 2017

(54) METHOD OF CUTTING LAMINATE FILM, CUTTING APPARATUS AND METHOD OF MANUFACTURING OPTICAL DISPLAY DEVICE

(75) Inventors: Satoru Koshio, Ibaraki (JP); Takuya Nakazono, Ibaraki (JP); Masahiro Takigawa, Ibaraki (JP)

(73) Assignee: NITTO DENKO CORPORATION, Ibaraki-shi (JP)

( * ) Notice: Subject to any disclaimer, the term of this patent is extended or adjusted under 35 U.S.C. 154(b) by 0 days.

(21) Appl. No.: 13/505,950

(22) PCT Filed: Mar. 3, 2011

(86) PCT No.: PCT/JP2011/054880

§ 371 (c)(1),
(2), (4) Date: May 3, 2012

(87) PCT Pub. No.: WO2011/111596

PCT Pub. Date: Sep. 15, 2011

(65) Prior Publication Data

US 2012/0211153 A1 Aug. 23, 2012

(30) Foreign Application Priority Data

Mar. 9, 2010 (JP) ..... 2010-051754

(51) Int. Cl.
*B26D 1/18* (2006.01)
*B26D 3/08* (2006.01)
(Continued)

(52) U.S. Cl.
CPC ..... *B26D 1/185* (2013.01); *B26D 1/18* (2013.01); *B26D 1/205* (2013.01); *B26D 3/08* (2013.01);
(Continued)

(58) Field of Classification Search
CPC .. B32B 38/04; B32B 38/004; B32B 2038/045; B26D 1/185; Y10T 83/4795
(Continued)

(56) References Cited

U.S. PATENT DOCUMENTS 5,765,460 A 6/1998 Wathieu
6,019,023 A * 2/2000 Betourne ..... 83/174
(Continued)

FOREIGN PATENT DOCUMENTS

CN 1530305 A 9/2004
CN 1672883 A 9/2005
(Continued)

OTHER PUBLICATIONS

Japanese Office Action mailed Jun. 1, 2012, issued in corresponding Japanese Patent Application No. 2010-051754, w/ English translation.
(Continued)

*Primary Examiner* — Philip Tucker
*Assistant Examiner* — Christopher C Caillouet
(74) *Attorney, Agent, or Firm* — Westerman, Hattori, Daniels & Adrian, LLP

(57) ABSTRACT

An object is to provide a method of cutting a laminate film by a circular cutter having a blade around its peripheral edge portion, including rotating the circular cutter at a blade peripheral speed of Vr by a rotational device in a forward rotational direction relative to the cutting direction, while, at the same time, moving the circular cutter at a moving speed of Vc, thereby cutting the laminate film, wherein the relative cutting speed V calculated by subtracting the blade peripheral speed Vr from the moving speed Vc falls within a range of not less than −50 m/min to not more than 30 m/min.

7 Claims, 5 Drawing Sheets

(51) Int. Cl.
*B26D 1/20* (2006.01)
*B26D 7/01* (2006.01)

(52) U.S. Cl.
CPC ..... *B26D 7/018* (2013.01); *Y10T 83/0515* (2015.04); *Y10T 83/4795* (2015.04); *Y10T 156/1062* (2015.01)

(58) Field of Classification Search
USPC ..... 156/250, 252, 253, 256
See application file for complete search history.

(56) References Cited

U.S. PATENT DOCUMENTS

| | | | |
|---|---|---|---|
| 8,182,637 | B2 | 5/2012 | Nakahira et al. |
| 2005/0211033 | A1 | 9/2005 | Matsuura |
| 2009/0159175 | A1 | 6/2009 | Nakahira et al. |
| 2012/0097316 | A1 | 4/2012 | Nakahira et al. |

FOREIGN PATENT DOCUMENTS

| | | | |
|---|---|---|---|
| CN | 101297339 | A | 10/2008 |
| CN | 101405111 | A | 4/2009 |
| JP | 1-240295 | A | 9/1989 |
| JP | 7-73836 | B2 | 8/1995 |
| JP | 9-323287 | A | 12/1997 |
| JP | 2000-501999 | A | 2/2000 |
| JP | 2002-172585 | A | 6/2002 |
| JP | 2004-042191 | A | 2/2004 |
| JP | 2005-305637 | A | 11/2005 |
| JP | 2007-260865 | A | 10/2007 |
| JP | 2008-000874 | A | 1/2008 |
| JP | 2008-063059 | A | 3/2008 |
| JP | 2008-161949 | A | 7/2008 |
| JP | 2009220268 | A | 10/2009 |
| JP | 2009-291844 | A | 12/2009 |
| JP | 2010-030035 | A | 2/2010 |
| KR | 10-2006-0044645 | A | 5/2006 |
| WO | 2009/104540 | A1 | 8/2009 |

OTHER PUBLICATIONS

Notification of Transmittal of Translation of the International Preliminary Report on Patentability (Forms PCT/IB/338) of International Application No. PCT/JP2011/054880 mailed Oct. 11, 2012, with Forms PCT/IB/326, PCT/IB/373 and PCT/ISA/237.

Japanese Office Action dated Sep. 21, 2012, issued in corresponding Japanese patent application No. 2010-051754, w/ English translation.

International Search Report of PCT/JP2011/054880, mailing date Jun. 7, 2011.

Chinese Office Action dated Jan. 13, 2014, issued in corresponding Chinese application No. 201180001859.9, w/ English translation of search report (10 pages).

Office Action dated Feb. 26, 2016, issued in counterpart Korean Patent Application No. 2011-7026790. (4 pages).

* cited by examiner

METHOD OF CUTTING LAMINATE FILM, CUTTING APPARATUS AND METHOD OF MANUFACTURING OPTICAL DISPLAY DEVICE

FIELD OF THE INVENTION

The present invention relates to a method and apparatus for cutting a laminate film having plural layers laminated together via adhesive layers, such as a polarizing film or any other optical films, and a method of manufacturing an optical display device.

RELATED ART

An optical film represented by, for example, a polarizing film and a retardation film is useful as an optical part of a liquid crystal display device or the like.

An example of the optical film includes a polarizing film having a laminate structure made up of a PVA polarizer, surface protection films laminated on both sides of the PVA polarizer via adhesive layers and a release film on one of the protection films via an adhesive layer, in which the PVA polarizer is formed by staining with iodine and stretching of a PVA (polyvinyl alcohol) film.

The polarizing film, which is generally formed into an elongated film and wound into a roll, is fed out to be cut into pieces each having a size corresponding to a liquid crystal cell to which the polarizing film is bonded, when in use.

Examples of the method of cutting a polarizing film as employed include a so-called full-cut method, which includes cutting a polarizing film together with a release film, and a so-called half cut method, which includes cutting the polarizing film with only the laminated release film remaining uncut to allow the PVA polarizer, which has been cut into pieces, to be jointed together by the release film and thus kept in a state where it can be transferred by roll-to-roll process.

As disclosed in the following Patent Document 1 and Patent Document 2, there is known a rotary circular cutter for use in cutting the polarizing film.

PRIOR ART DOCUMENTS

Patent Documents

Patent Document 1: Japanese Patent Application Laid-open No. 2007-260865

Patent Document 2: Japanese Patent Application Laid-open No. 2008-63059

Patent Documents 1 and 2 disclose a cutting method, in which a rotary cutter is non-rotatably mounted to a cutting apparatus, and is moved in a cutting direction of a laminate film to cut the laminate film.

Patent Document 1 also discloses a cutting method, in which a rotary cutter is freely rotatably mounted to a cutting apparatus, and is moved in a cutting direction of a laminate film to cut the laminate film.

Both of the Documents disclose that any of those methods makes it possible to prevent or reduce occurrence of cut refuse during cutting operation.

An optical film, such as the aforesaid polarizing film, is made up of exclusively thin films laminated together through adhesive layers. When this laminate film is to be cut, defects, such as frays or rough cut edges, lifting of a surface protection film, or cracking in a polarizer due to heating or cooling of a polarizing film may occur.

Any of the cutting methods disclosed in Patent Documents 1 and 2 have not been able to satisfactorily reduce or prevent the occurrence of such defect products during cutting such an optical film.

DISCLOSURE OF THE INVENTION

Problems to be Solved by the Invention

It is an object of the present invention to provide a cutting method, a cutting apparatus and a method of manufacturing an optical display device, which are capable of reducing or preventing occurrence of defect products in a cutting operation of a laminate film and thus realizing cut process for a laminate film at a high yield.

Means for Solving Problems

According to the present invention relating to a laminate film cutting method, there is provided a method of cutting a laminate film by a circular cutter having a blade around its peripheral edge portion, including rotating the circular cutter at a blade peripheral speed of Vr by a rotational device in a forward rotational direction relative to the cutting direction, while, at the same time, moving the circular cutter at a moving speed of Vc, thereby cutting the laminate film, wherein the relative cutting speed V calculated by subtracting the blade peripheral speed Vr from the moving speed Vc falls within a range of not less than −50 m/min to not more than 30 m/min.

Herein, by the direction in which the circular cutter is rotated in a forward rotational direction relative to the cutting direction is meant a rotational direction in which the upstream side of the circular cutter relative to the moving direction cuts deeply into the laminate film through its surface.

In the laminate film cutting method of the present invention, the laminate film is preferably a polarizing film including a polarizing layer and a release film layer laminated on at least one side of the polarizing layer via an adhesive layer.

According to the present invention relating to a laminate film cutting apparatus, there is provided an apparatus for cutting a laminate film, which is provided with a cutting device that includes a circular cutter having a blade around its peripheral edge portion, including a rotational device that rotates the circular cutter at a blade peripheral speed of Vr in a forward rotational direction relative to the cutting direction, a moving device that moves the circular cutter at a moving speed of Vc in the cutting direction; and a control device that controls the circular cutter so that the relative cutting speed V calculated by subtracting the blade peripheral speed Vr from the moving speed Vc, of the circular cutter, falls within a range of not less than −50 m/min to not more than 30 m/min.

According to the present invention relating to an optical display device manufacturing method, there is provided a method of manufacturing an optical display device by cutting a laminate film and bonding the cut laminate film to an optical display unit, comprising a step of cutting a laminate film by the aforesaid cutting method.

Advantages of the Invention

According to the present invention, it is possible to provide a laminate film cutting method and apparatus, and an optical display device manufacturing method that can be easily realized in a simple manner while preventing or reducing occurrence of defects, such as frays or rough cut edges, or lifting of a film during a laminate film is cut.

When a polarizing film that includes a polarizing layer and a release film layer laminated on at least one side of the polarizing layer via an adhesive layer is employed as the laminate film to be cut in the present invention, and the laminate film is cut by the method of the present invention, it is possible to prevent or reduce occurrence of cracking in a polarizer of the polarizing film.

DETAILED DESCRIPTION OF THE PREFERRED EMBODIMENT

Now, the description will be made for a laminate film cutting method and a manufacturing apparatus of this embodiment with reference to FIGS. 1 to 6.

Figure 1A:
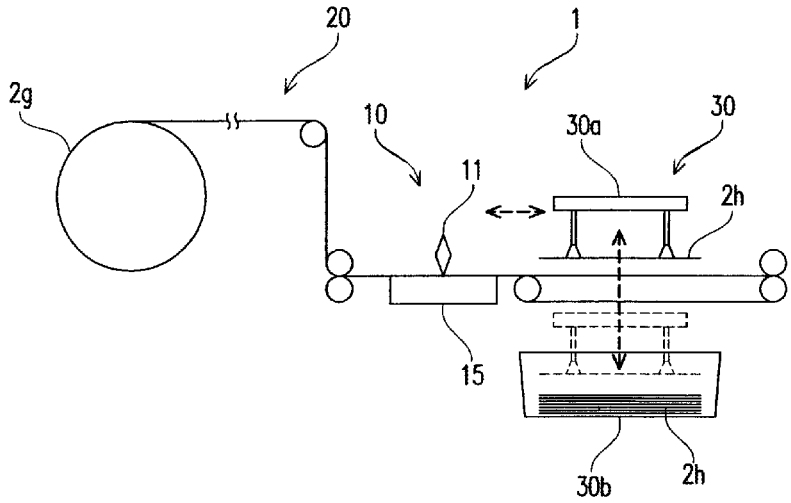
FIGS. 1(*a*) and 1(*b*) are schematic views showing the overall structure of a laminate film cutting apparatus according to one embodiment.
Figure 1B:
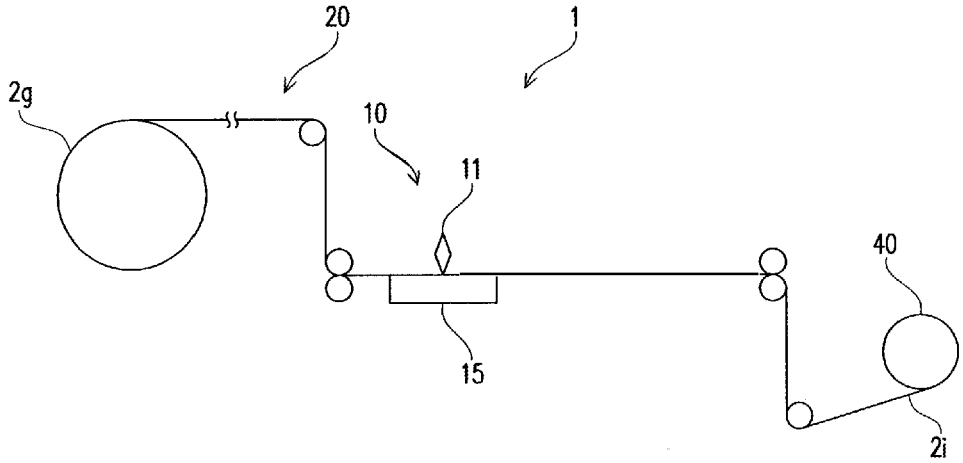

FIGS. 1(*a*) and 1(*b*) are schematic views showing the overall structure of a laminate film cutting apparatus 1 of this embodiment.

The laminate film cutting apparatus 1 includes a cutting device 10 that cuts a laminate film. The laminate film cutting apparatus 1 of this embodiment further includes a film transfer device 20 that draws out a laminate film from a web roll 2*g* of a laminate film and transfers the same to the cutting device 10, and a film recovering device 30 as shown in FIG. 1(*a*), which recovers a laminate film cut by the cutting device 10, or a film winding device 40 as shown in FIG. 1(*b*), which winds a laminate film cut by the cutting device 10.

Figure 2:
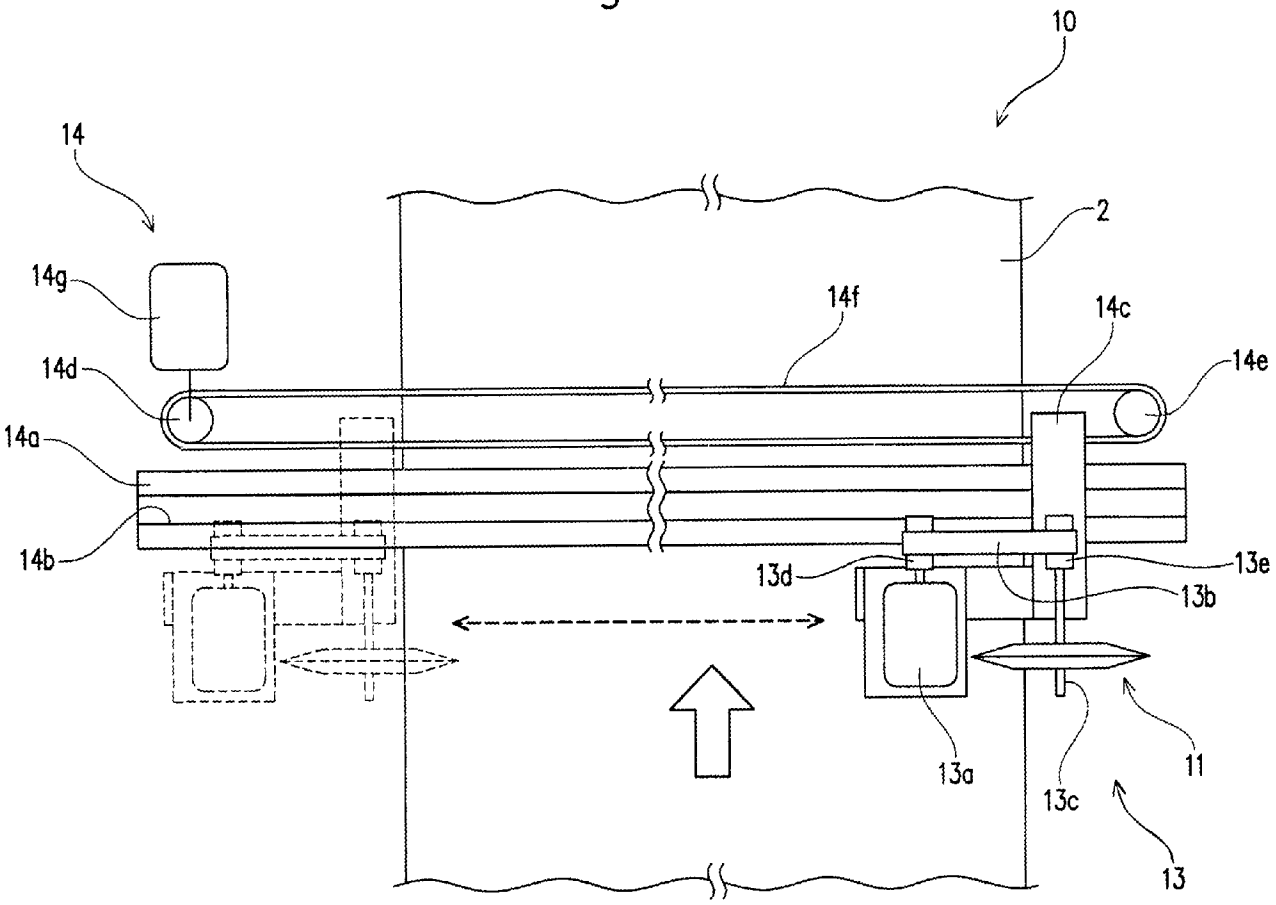
FIG. 2 is a top plan view showing a cutting device of a cutting apparatus.

As shown in FIG. 2, the cutting device 10 includes a circular cutter 11, a rotating device 13 that rotates the circular cutter 11, and a moving device 14 that moves the circular cutter 11 in the cutting direction of a laminate film. Furthermore, the cutting device 10 of this embodiment includes a support block 15 located under the circular cutter 11, as shown in FIG. 1.

Figure 4:
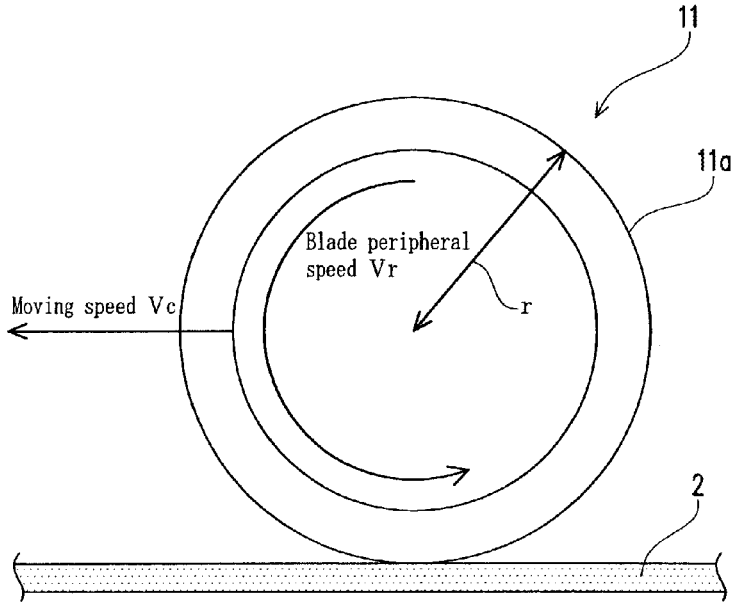
FIG. 4 is an enlarged schematic view showing the rotational direction and the moving direction, of a circular cutter.
Figure 5:
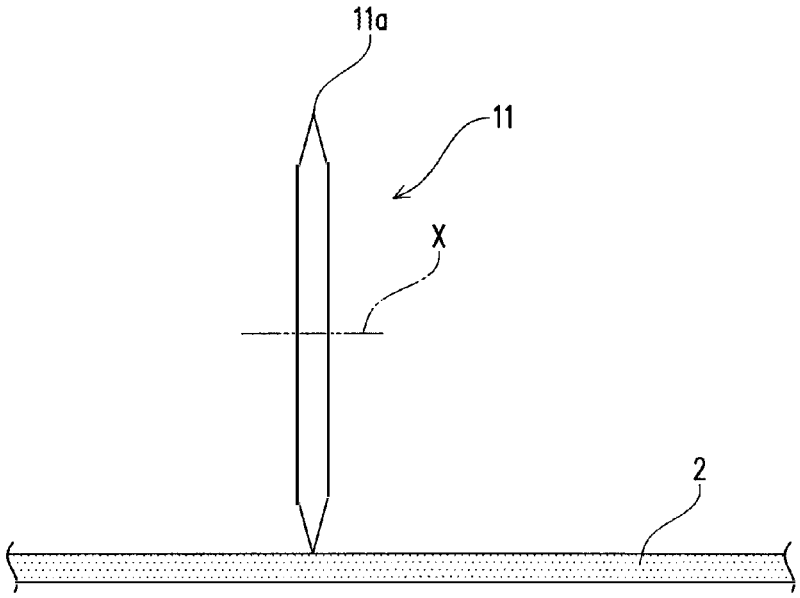
FIG. 5 is an enlarged schematic view showing the cutting position of the circular cutter.
Figure 6:
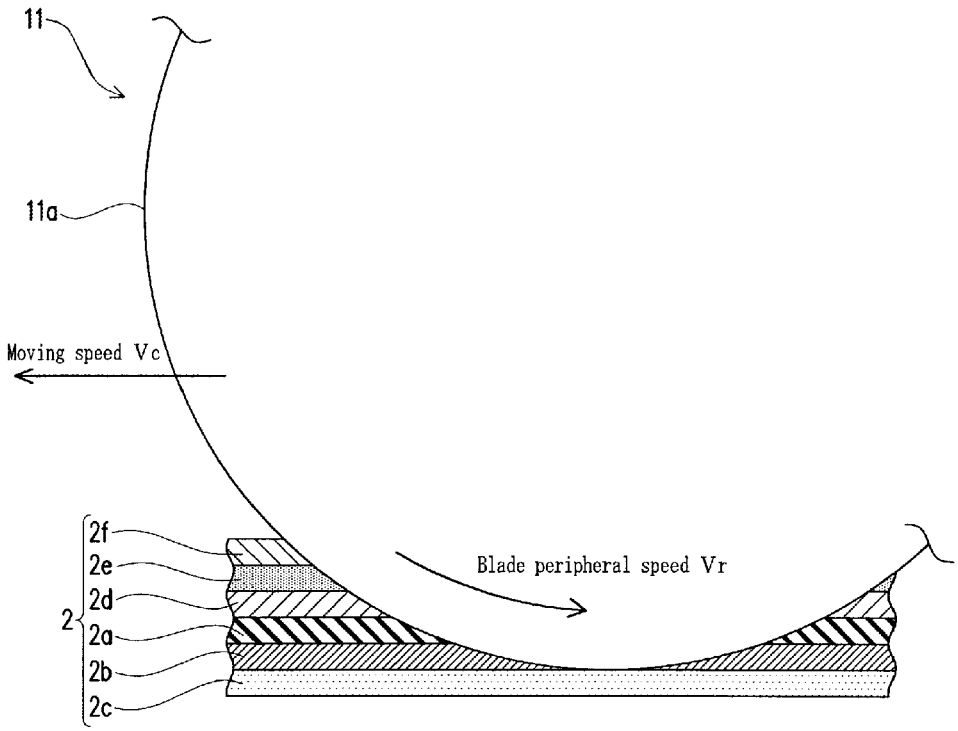
FIG. 6 is an enlarged schematic view showing the circular cutter, which is held in cutting operation.

The circular cutter 11 has a blade 11*a* with a polished circumferential edge portion 11*a*, as shown in FIGS. 4 and 5.

Any cutter may be used for the circular cutter 11 as long as it is used for cutting a conventional optical film. Examples of the circular cutter 11 include a cutter made of metal, such as iron, iron alloy, steel or stainless steel, a cutter made of titanium nitride, titanium carbide, tungsten carbide or ceramics, and a cutter further subjected to surface treatment, such as diamond-like carbon.

The circular cutter 11 may change in terms of diameter, thickness of a cutting edge or angle of the leading end, while the thickness of the circular cutter 11 is in a range of not less than 0.1 mm to not more than 1.0 mm, preferably in a range of not less than 0.1 mm to not more than 0.5 mm.

By the thickness of the circular cutter 11 is herein meant a thickness of a thickest portion of the circular cutter 11. The angle of the leading end of a blade 11*a* of the circular cutter 11 is preferably in a range of not less than 10° to not more than 40°, and preferably in a range of not less than 15° to not more than 30°. When the leading end of the blade 11*a* is smaller than 40°, there is an advantageous effect in that it is less likely to cause defects in cutting of a laminate film.

When the angle of the leading end of the blade 11*a* is greater than 10°, the blade has a high durability to provide an advantageous effect of reducing the number of replacement times of the blade due to wear. Furthermore, the circular cutter 11 has a diameter preferably in a range of not less than 40 mm to not more than 120 mm.

The rotating device 13 includes a motor 13*a*, a pulley belt 13*b* that is wound between two pulleys 13*d*, 13*e*, and a rotating shaft 13*c* with the circular cutter 11 mounted thereto.

The motor 13*a* is connected to one of the two pulleys, namely the pulley 13*d*, in which the other pulley 13*e* is connected to the rotating shaft 13*c*.

The circular cutter 11 has a center shaft fixedly mounted to the rotating shaft 13*c*, so that, when the motor 13*a* rotates, the rotational force is transmitted to the rotating shaft 13*c* via the pulley belt 13*b* to rotate the circular cutter 11.

The moving device 14 includes a rail member 14*a* having a top side provided at its center portion with a groove 14*b* extending in the longitudinal direction, two pulleys 14*d*, 14*e* located at both ends of the rail member 14*a* in the longitudinal direction, a pulley belt 14*f* wound between the pulleys 14*d*, 14*e*, and a motor 14*g* connected to the pulley 14*d*.

The rail member 14*a* is located above an oncoming laminate film to have a width direction of the laminate film oriented in parallel to the longitudinal direction of the rail member 14*a*.

A movable member fits in the groove 14*b* of the rail member 14*a* so as to be slidable along the groove 14*b* and a support arm 14*c* is secured on the top of the movable member.

The rotating device 13 is mounted on the top side of the support arm 14*c* and the pulley belt 14*f* is secured to one end of the support arm 14*c*.

Upon rotation of the motor 14*g*, the pulley belt 14*f* is rotated through the pulley 14*d* connected to the motor 14*g*. At this moment, the support arm 14*c*, which is secured to the pulley belt 14*f*, applies a force to the support arm 14*c* in a rotational direction of the pulley belt 14*f*.

On the other hand, the support arm 14*c*, which has a lower side movably mounted to the rail member 14*a* via the movable member, is moved in a width direction of a laminate film along the groove 14*b* upon rotation of the pulley belt 14*f*.

With the support arm 14*c* having the upper side, to which the cutting device 13 is mounted, the rotating shaft 13*c* and the circular cutter 11 mounted to the rotating shaft 13*c* are moved along with the support arm 14*c* in the width direction of the laminate film.

That is, upon the simultaneous driving of the motors 13*a*, 14*g*, it is possible to rotate the circular cutter 11 while moving the same in the cutting direction of the laminate film.

The motors 13*a*, 14*g* are respectively connected to control devices (not shown) and are configured to be each controlled appropriately in terms of the rotational speed and the rotational direction.

That is, upon control of the motors 13*a*, 14*g* in terms of the rotational speed and rotational direction, it is possible to control the rotational speed and rotational direction of the circular cutter 11, and the moving direction and moving speed of the circular cutter 11.

The film recovering device 30 includes a suction device 30*a* that sucks the cut laminate film, a slide member (not shown) that slides the suction device 30*a* in the width direction of the laminate film and the vertical direction, and a storing portion 30*b* that stores the laminate films sucked by the suction device 30*a*.

The film recovering device 30 is used in a case where the laminate film is cut by the full-cut method, as described hereinafter.

The film winding device 40 is used in a case where the laminate film is cut by the half-cut method, and includes a roll to wind up the cut laminate film.

Now, the description will be made for a method of cutting a laminate film by using the cutting apparatus of this embodiment.

Figure 3:
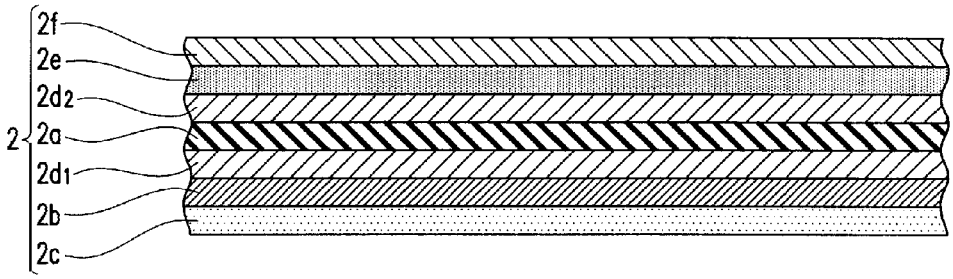
FIG. 3 is an enlarged cross sectional view showing a laminate structure of a laminate film to be cut.

As a laminate film to be cut by the laminate film cutting apparatus 1 of this embodiment, a polarizing film 2 having the structure as shown in FIG. 3 is used.

The polarizing film 2 is formed by staining a PVA film with iodine and then stretching the same, and includes a polarizing layer 2*a* having opposite sides on which protection layers 2*d*1, 2*d*2 are provided. An adhesive layer 2*b* is provided on the first side of the polarizing layer 2*a* via the protection layer 2*d*1, and a release film layer 2*c* is provided on the first side of the polarizing layer 2*a* via the release film layer 2*c*. An adhesive layer 2*e* is provided on the second side of the polarizing layer 2*a* via the protection layer 2*d*2, and a surface protection layer 2*f* is provided on the second side of the polarizing layer 2*a* via the adhesive layer 2*e*.

The thus structured polarizing film 2 is formed as the web roll 2*g* by laminating the respective layers together and winding up the laminate.

As shown in FIG. 1, the web roll 2*g* formed by winding up the polarizing film 2 is installed in the laminate film cutting apparatus 1, and is supplied to the cutting device 10 by the film transfer device 20.

At this moment, the polarizing film 2 is supplied onto the support block 15 of the cutting device 10 so as to have the surface protection layer 2*f* located on the side on which the circular cutter 11 is located.

The polarizing film 2 is cut by the circular cutter 11 of the cutting device 10 into a predetermined size. The circular cutter 11 is rotated at a predetermined rotational speed by the motor 13*a* as described above, while, at the same time, moved in the cutting direction of the polarizing film 2 by the motor 14*g* of the moving device 14, thereby cutting the polarizing film 2.

As shown in FIG. 1, the rotational direction of the circular cutter 11 is set in such a direction as to allow the upstream side of the circular cutter 11 relative to the moving direction of the circular cutter 11 to cut deeply into the polarizing film 2 through the surface of the polarizing film 2.

Such a rotational direction is herein referred to as the forward rotational direction.

When the rotational direction of the circular cutter is reversed, or when the circular cutter is rotated in the reversed direction, cracking or lifting of a surface protection film easily occurs.

At this moment, the rotational speed and the moving speed of the circular cutter are controlled so that a relative cutting speed V calculated by subtracting a blade peripheral speed Vr from a moving speed Vc of the circular cutter 11 falls within a range of not less than −50 m/min to not more than 30 m/min.

By cutting a polarizing film with the relative cutting speed V falling within a range of not less than −50 m/min to not more than 30 m/min, preferably in a range of not less than −30 m/min to not more than 20 m/min, and more preferably in a range of not less than −20 m/min to not more than 10 m/min, it is possible to cut the polarizing film while preventing or reducing occurrence of frays or rough cut edges, or lifting of a layer of a polarizing film from the adjacent layer, or cracking of a polarizing layer.

The blade peripheral speed Vr of the circular cutter 11 is calculated by multiplying the angular speed of the circular cutter by the radius of the circular cutter 11.

The polarizing film 2 is cut into a predetermined size by the circular cutter 11 and transferred to the subsequent step in which it is bonded to a liquid cell.

When the half-cut method, which transfers the polarizing film 2 to the subsequent step while leaving the same uncut, uncut, is employed as a method of cutting the polarizing film 2, a polarizing film 2*i* is left in a continuous band shape by the release film layer 2*c* even after the cutting operation, so that the film is wound up by the film winding device 40 and transferred in a rolled state to the subsequent step.

On the other hand, when the full-cut method, which cuts the film together with the release film layer 2*c* into sheets and transfers the sheets to the subsequent step, is employed as the method of cutting the polarizing film 2, the sheets are recovered into the film recovering device 30, as shown in FIG. 1(*a*).

That is, a polarizing film 2*h* is cut into sheets, the sheets are each sucked by the suction device 30*a*, and the suction device 30*a* is moved upward with the sheets of the polarizing film 2*h* held thereto by the slide member and moved toward the side of the film transfer device 20.

The storing portion 30*b* is installed on the side of the film transfer device 20 so that the sheets of the polarizing film 2*h* are transferred into the storing portion 30*b* and then removed from the suction device 30*a*.

As a specific means of sucking the cut sheets of the polarizing film 2*h*, it is possible to employ a known suction means such as electrostatic suction and vacuum suction.

When the half-cut method is employed as a method of cutting the polarizing film 2, the roundness of the circular cutter is within a range of not more than ±30 μm and preferably ± (plus minus) 10 μm.

The roundness is herein meant a roundness determined by the measuring method described in JIS B 0182, Machine accuracy and working accuracy, No. 356.

A laminate film to be cut by the cutting method of the present invention is not necessarily limited to a polarizing film having the above structure, as long as a film is a sheet having a film shape of a laminate structure of plural layers.

Especially, an optical film, such as a polarizing film having a release film layer via an adhesive layer, deteriorates in its optical characteristics or production yield due to frays or rough cut edges, lifting of a layer, or cracking, and hence it is possible to reduce the percent defective by the cutting method of the present invention.

Although no limitation is intended to the thickness of a laminate film, if a laminate film has a thickness of, for example, about 80 μm to 400 μm, it can be appropriately cut.

An optical display device can be manufactured by laminating a laminate film cut by the cutting method of the present invention onto an optical display unit as an optical member.

Examples of the optical display device include a liquid crystal display device and an organic light emitting display device.

These optical display devices are manufactured by laminating a laminate film cut by the cutting method of the present invention onto a liquid cell or an organic light emitting cell as an optical display unit.

In the method of manufacturing an optical display device, for the method used for manufacturing an optical display device, it is possible to employ a know method other than the cutting method of the present invention.

For example, the method may include forming the laminate film into a continuous rolled shape by the half-cut method using the release film layer 2*c*, and transferring the rolled film to a bonding step to bond the film onto an optical display unit, in which each cut piece of the laminate film is bonded onto each of optical display units, which are subsequently transferred, via the adhesive layer 2*b* while the continuous release film layer 2*c* is peeled off from each cut piece of the laminate film.

Alternatively, the method may include transferring cut pieces of a laminate film, which were cut by the full-cut method and stored in the storing portion 30*b*, to a bonding step, in which cut pieces of the laminate film are bonded one by one to the top surfaces of optical display units via the adhesive layer 2*b*.

As described above, it is unlikely to cause frays or rough cut edges, or layer lifting in the laminate film cut by the cutting method of the present invention. Thus, it is possible to produce a high-quality optical display device by bonding this laminate film onto an optical display unit.

In this embodiment, as a device for rotating the circular cutter, the description was made by taking, for example, the device for rotating the circular cutter by transmitting the rotation of the motor via the pulley belt to the rotating shaft of the circular cutter. This is not essential. For example, it is possible to employ a method, which includes transmitting the driving force from a rotary driving motor to the rotating shaft of the circular cutter via a gear, or any other methods.

In this embodiment, as a device for moving the circular cutter, the description was made by taking, for example, the device that includes the slidingly movable member with the circular cutter mounted thereto and is moved by transmitting the driving force via the pulley belt. The device for moving the circular cutter is not necessarily limited thereto. For example, it is possible to employ a device for moving a cutter by a driving device, such as a linear type actuator, or any other devices.

EXAMPLES

Now, the description will be made in further detail for the present invention with reference to Examples without intention to limit thereto.

Laminate Film

For Examples and Comparative Examples, three kinds of samples of polarizing film were used, namely Sample A (Product name: NPF-VEG1724 DU, manufactured by Nitto Denko Corporation), Sample B (Product Name: NTB-EFCVEQ-K1, manufactured by Nitto Denko Corporation) and Sample C (Product name: NZB-CVEQ-ST19, manufactured by Nitto Denko Corporation).

These polarizing films were each prepared in the form of a web roll having a width of 400 mm and a length of 50 m.

Apparatus

As a cutting apparatus, a cutting test machine of a roll feeder type with a self-propelled circular cutter was used.

For a circular cutter, a super-hard cutter, FW05 manufactured by Kyocera Corporation was used, and cutters of the following five different sizes were prepared.

Blade diameter: 60 mm, Blade thickness: 0.5 mm, Angle of leading end: 20°

Blade diameter: 80 mm, Blade thickness: 0.2 mm, Angle of leading end: 20°

Blade diameter: 80 mm, Blade thickness: 0.5 mm, Angle of leading end: 20°

Blade diameter: 80 mm, Blade thickness: 1.0 mm, Angle of leading end: 20°

Blade diameter: 100 mm, Blade thickness: 0.5 mm, Angle of leading end: 20°

The blade thickness is herein meant a thickness of the thickest portion of the circular cutter.

Under the conditions shown in Tables 1-3 with using the above apparatus, the Samples A to C were each cut into a size of 50 mm by 400 mm, and evaluations were made for the respective cut Samples.

The rotational mode is herein represented by "self-propelled", in which each of the circular cutters is mounted to the rotating shaft and thereby is controlled to be rotated at a predetermined speed; "fixed", in which each of the circular cutters is secured to a non-rotating shaft so as not to be rotatable; and "free", in which each of the circular cutters is non-fixedly mounted to a shaft so as to be freely rotatable.

The cutting mode is herein represented by "half-cut", in which a polarizing film of each Sample is cut while leaving a release film uncut; and "full-cut", in which a polarizing film of each Sample is cut together with a release film The rotational direction is herein represented by "forward rotational direction", in which the upstream side of the circular cutter relative to the moving direction cuts deeply into the polarizing film 2; and the opposite direction to the forward rotational direction, that is, "reverse rotational direction", in which the tail end of the circular cutter relative to the moving direction cuts deeply into the polarizing film 2 through its surface.

The relative cutting speed V at the time of cutting was calculated by the following equation on the basis of each of the cutting conditions.

Relative cutting speed $V$=moving speed $Vc$−blade peripheral speed $Vr$

Blade peripheral speed $Vr$ (m/min)=angular speed of a circular cutter (rad/min)×radius of a circular cutter (m)

According to this evaluation method, three kinds of evaluation were made for each of the cut Samples (number of each Sample=10)

Cracks

Each cut Sample was bonded to an alkali-free glass plate (Product name: EAGLE XG, manufactured by Corning Inc.) by a bonding test machine, and subjected to a heat shock test at −40° C. to 70° C. (20 cycles) by a heat shock test machine (Machine name: TSA-101S, manufactured by ESPEC Corporation).

Then, the presence or absence of a crack having a size of 0.5 mm or more was confirmed by visual observation of an edge of each Sample, and a Sample with a crack was counted as one piece.

Frays or Rough Cut Edges

Presence or absence of frays or rough cut edges having a size of 1.0 mm or more was confirmed by visual observation of each cut Sample with a microscope, and a Sample with such frays or rough cut edges was counted as one piece.

Lifting of a Surface Protection Film

Presence or absence of a lifting portion of 0.5 mm or more of a surface protection layer was confirmed by visual observation of each cut Sample with a microscope, and a Sample with a lifting portion was counted as one piece.

The results are shown in Tables 1-3.

TABLE 1

| | Blade dia. (mm) | Blade thickness (mm) | Rotational mode | Cutting mode | Rotational direction | Vc (m/min) | Vr (m/min) | V (m/min) |
|---|---|---|---|---|---|---|---|---|
| Ex. 1 | 60 | 0.5 | Self-propelled | Half-cut | Forward | 50 | 20 | 30 |
| Ex. 2 | 60 | 0.5 | Self-propelled | Half-cut | Forward | 50 | 30 | 20 |
| Ex. 3 | 60 | 0.5 | Self-propelled | Half-cut | Forward | 50 | 40 | 10 |
| Ex. 4 | 60 | 0.5 | Self-propelled | Half-cut | Forward | 50 | 50 | 0 |
| Ex. 5 | 60 | 0.5 | Self-propelled | Half-cut | Forward | 50 | 60 | −10 |
| Ex. 6 | 60 | 0.5 | Self-propelled | Half-cut | Forward | 50 | 70 | −20 |
| Ex. 7 | 60 | 0.5 | Self-propelled | Half-cut | Forward | 50 | 80 | −30 |
| Ex. 8 | 60 | 0.5 | Self-propelled | Half-cut | Forward | 50 | 90 | −40 |
| Ex. 9 | 60 | 0.5 | Self-propelled | Half-cut | Forward | 50 | 100 | −50 |
| Ex. 10 | 80 | 0.5 | Self-propelled | Half-cut | Forward | 50 | 20 | 30 |
| Ex. 11 | 80 | 0.5 | Self-propelled | Half-cut | Forward | 50 | 30 | 20 |
| Ex. 12 | 80 | 0.5 | Self-propelled | Half-cut | Forward | 50 | 40 | 10 |
| Ex. 13 | 80 | 0.5 | Self-propelled | Half-cut | Forward | 50 | 50 | 0 |
| Ex. 14 | 80 | 0.5 | Self-propelled | Half-cut | Forward | 50 | 60 | −10 |
| Ex. 15 | 80 | 0.5 | Self-propelled | Half-cut | Forward | 50 | 70 | −20 |
| Ex. 16 | 80 | 0.5 | Self-propelled | Half-cut | Forward | 50 | 80 | −30 |
| Ex. 17 | 80 | 0.5 | Self-propelled | Half-cut | Forward | 50 | 90 | −40 |
| Ex. 18 | 80 | 0.5 | Self-propelled | Half-cut | Forward | 50 | 100 | −50 |
| Ex. 19 | 100 | 0.5 | Self-propelled | Half-cut | Forward | 50 | 20 | 30 |
| Ex. 20 | 100 | 0.5 | Self-propelled | Half-cut | Forward | 50 | 30 | 20 |
| Ex. 21 | 100 | 0.5 | Self-propelled | Half-cut | Forward | 50 | 40 | 10 |
| Ex. 22 | 100 | 0.5 | Self-propelled | Half-cut | Forward | 50 | 50 | 0 |
| Ex. 23 | 100 | 0.5 | Self-propelled | Half-cut | Forward | 50 | 60 | −10 |
| Ex. 24 | 100 | 0.5 | Self-propelled | Half-cut | Forward | 50 | 70 | −20 |
| Ex. 25 | 100 | 0.5 | Self-propelled | Half-cut | Forward | 50 | 80 | −30 |
| Ex. 26 | 100 | 0.5 | Self-propelled | Half-cut | Forward | 50 | 90 | −40 |
| Ex. 27 | 100 | 0.5 | Self-propelled | Half-cut | Forward | 50 | 100 | −50 |

| | Sample A | | | Sample B | | | Sample C | | |
|---|---|---|---|---|---|---|---|---|---|
| | Crack (piece) | Fray (piece) | Lifting (piece) | Crack (piece) | Fray (piece) | Lifting (piece) | Crack (piece) | Fray (piece) | Lifting (piece) |
| Ex. 1 | 0 | 0 | 3 | 0 | 0 | 3 | 0 | 0 | 2 |
| Ex. 2 | 0 | 0 | 2 | 0 | 0 | 2 | 0 | 0 | 1 |
| Ex. 3 | 0 | 0 | 0 | 0 | 0 | 0 | 0 | 0 | 0 |
| Ex. 4 | 0 | 0 | 0 | 0 | 0 | 0 | 0 | 0 | 0 |
| Ex. 5 | 0 | 0 | 0 | 0 | 0 | 0 | 0 | 0 | 0 |
| Ex. 6 | 0 | 0 | 0 | 0 | 0 | 0 | 0 | 0 | 0 |
| Ex. 7 | 0 | 0 | 1 | 0 | 0 | 2 | 0 | 0 | 1 |
| Ex. 8 | 0 | 0 | 1 | 0 | 0 | 1 | 0 | 0 | 1 |
| Ex. 9 | 0 | 0 | 2 | 0 | 0 | 2 | 0 | 0 | 1 |
| Ex. 10 | 0 | 0 | 2 | 0 | 0 | 1 | 0 | 0 | 3 |
| Ex. 11 | 0 | 0 | 2 | 0 | 0 | 1 | 0 | 0 | 1 |
| Ex. 12 | 0 | 0 | 0 | 0 | 0 | 0 | 0 | 0 | 0 |
| Ex. 13 | 0 | 0 | 0 | 0 | 0 | 0 | 0 | 0 | 0 |
| Ex. 14 | 0 | 0 | 0 | 0 | 0 | 0 | 0 | 0 | 0 |
| Ex. 15 | 0 | 0 | 0 | 0 | 0 | 0 | 0 | 0 | 0 |
| Ex. 16 | 0 | 0 | 1 | 0 | 0 | 2 | 0 | 0 | 1 |
| Ex. 17 | 0 | 0 | 1 | 0 | 0 | 2 | 0 | 0 | 2 |
| Ex. 18 | 0 | 0 | 1 | 0 | 0 | 3 | 0 | 0 | 2 |
| Ex. 19 | 0 | 0 | 3 | 0 | 0 | 3 | 0 | 0 | 2 |
| Ex. 20 | 0 | 0 | 2 | 0 | 0 | 1 | 0 | 0 | 1 |
| Ex. 21 | 0 | 0 | 0 | 0 | 0 | 0 | 0 | 0 | 0 |
| Ex. 22 | 0 | 0 | 0 | 0 | 0 | 0 | 0 | 0 | 0 |
| Ex. 23 | 0 | 0 | 0 | 0 | 0 | 0 | 0 | 0 | 0 |
| Ex. 24 | 0 | 0 | 0 | 0 | 0 | 0 | 0 | 0 | 0 |
| Ex. 25 | 0 | 0 | 2 | 0 | 0 | 1 | 0 | 0 | 1 |
| Ex. 26 | 0 | 0 | 1 | 0 | 0 | 1 | 0 | 0 | 1 |
| Ex. 27 | 0 | 0 | 3 | 0 | 0 | 2 | 0 | 0 | 2 |

TABLE 2

| | Blade dia. (mm) | Blade thickness (mm) | Rotational mode | Cutting mode | Rotational direction | Vc (m/min) | Vr (m/min) | V (m/min) |
|---|---|---|---|---|---|---|---|---|
| Ex. 28 | 80 | 0.5 | Self-propelled | Full-cut | Forward | 50 | 20 | 30 |
| Ex. 29 | 80 | 0.5 | Self-propelled | Full-cut | Forward | 50 | 30 | 20 |
| Ex. 30 | 80 | 0.5 | Self-propelled | Full-cut | Forward | 50 | 40 | 10 |
| Ex. 31 | 80 | 0.5 | Self-propelled | Full-cut | Forward | 50 | 50 | 0 |
| Ex. 32 | 80 | 0.5 | Self-propelled | Full-cut | Forward | 50 | 60 | −10 |
| Ex. 33 | 80 | 0.5 | Self-propelled | Full-cut | Forward | 50 | 70 | −20 |
| Ex. 34 | 80 | 0.5 | Self-propelled | Full-cut | Forward | 50 | 80 | −30 |
| Ex. 35 | 80 | 0.5 | Self-propelled | Full-cut | Forward | 50 | 90 | −40 |
| Ex. 36 | 80 | 0.5 | Self-propelled | Full-cut | Forward | 50 | 100 | −50 |
| Ex. 37 | 80 | 0.2 | Self-propelled | Half-cut | Forward | 50 | 20 | 30 |
| Ex. 38 | 80 | 0.2 | Self-propelled | Half-cut | Forward | 50 | 30 | 20 |
| Ex. 39 | 80 | 0.2 | Self-propelled | Half-cut | Forward | 50 | 40 | 10 |
| Ex. 40 | 80 | 0.2 | Self-propelled | Half-cut | Forward | 50 | 50 | 0 |
| Ex. 41 | 80 | 0.2 | Self-propelled | Half-cut | Forward | 50 | 60 | −10 |
| Ex. 42 | 80 | 0.2 | Self-propelled | Half-cut | Forward | 50 | 70 | −20 |
| Ex. 43 | 80 | 0.2 | Self-propelled | Half-cut | Forward | 50 | 80 | −30 |
| Ex. 44 | 80 | 0.2 | Self-propelled | Half-cut | Forward | 50 | 90 | −40 |
| Ex. 45 | 80 | 0.2 | Self-propelled | Half-cut | Forward | 50 | 100 | −50 |
| Ex. 46 | 80 | 1 | Self-propelled | Half-cut | Forward | 50 | 20 | 30 |
| Ex. 47 | 80 | 1 | Self-propelled | Half-cut | Forward | 50 | 30 | 20 |
| Ex. 48 | 80 | 1 | Self-propelled | Half-cut | Forward | 50 | 40 | 10 |
| Ex. 49 | 80 | 1 | Self-propelled | Half-cut | Forward | 50 | 50 | 0 |
| Ex. 50 | 80 | 1 | Self-propelled | Half-cut | Forward | 50 | 60 | −10 |
| Ex. 51 | 80 | 1 | Self-propelled | Half-cut | Forward | 50 | 70 | −20 |
| Ex. 52 | 80 | 1 | Self-propelled | Half-cut | Forward | 50 | 80 | −30 |
| Ex. 53 | 80 | 1 | Self-propelled | Half-cut | Forward | 50 | 90 | −40 |
| Ex. 54 | 80 | 1 | Self-propelled | Half-cut | Forward | 50 | 100 | −50 |

| | Sample A | | | Sample B | | | Sample C | | |
|---|---|---|---|---|---|---|---|---|---|
| | Crack (piece) | Fray (piece) | Lifting (piece) | Crack (piece) | Fray (piece) | Lifting (piece) | Crack (piece) | Fray (piece) | Lifting (piece) |
| Ex. 28 | 0 | 0 | 2 | 0 | 0 | 2 | 0 | 0 | 3 |
| Ex. 29 | 0 | 0 | 2 | 0 | 0 | 1 | 0 | 0 | 1 |
| Ex. 30 | 0 | 0 | 0 | 0 | 0 | 0 | 0 | 0 | 0 |
| Ex. 31 | 0 | 0 | 0 | 0 | 0 | 0 | 0 | 0 | 0 |
| Ex. 32 | 0 | 0 | 0 | 0 | 0 | 0 | 0 | 0 | 0 |
| Ex. 33 | 0 | 0 | 0 | 0 | 0 | 0 | 0 | 0 | 0 |
| Ex. 34 | 0 | 0 | 1 | 0 | 0 | 1 | 0 | 0 | 1 |
| Ex. 35 | 0 | 0 | 1 | 0 | 0 | 2 | 0 | 0 | 2 |
| Ex. 36 | 0 | 0 | 3 | 0 | 0 | 2 | 0 | 0 | 3 |
| Ex. 37 | 0 | 0 | 1 | 0 | 0 | 1 | 0 | 0 | 2 |
| Ex. 38 | 0 | 0 | 0 | 0 | 0 | 0 | 0 | 0 | 1 |
| Ex. 39 | 0 | 0 | 0 | 0 | 0 | 0 | 0 | 0 | 0 |
| Ex. 40 | 0 | 0 | 0 | 0 | 0 | 0 | 0 | 0 | 0 |
| Ex. 41 | 0 | 0 | 0 | 0 | 0 | 0 | 0 | 0 | 0 |
| Ex. 42 | 0 | 0 | 0 | 0 | 0 | 0 | 0 | 0 | 0 |
| Ex. 43 | 0 | 0 | 0 | 0 | 0 | 0 | 0 | 0 | 0 |
| Ex. 44 | 0 | 0 | 0 | 0 | 0 | 1 | 0 | 0 | 0 |
| Ex. 45 | 0 | 0 | 1 | 0 | 0 | 1 | 0 | 0 | 1 |
| Ex. 46 | 0 | 0 | 3 | 0 | 0 | 3 | 0 | 0 | 3 |
| Ex. 47 | 0 | 0 | 3 | 0 | 0 | 2 | 0 | 0 | 2 |
| Ex. 48 | 0 | 0 | 2 | 0 | 0 | 2 | 0 | 0 | 1 |
| Ex. 49 | 0 | 0 | 0 | 0 | 0 | 0 | 0 | 0 | 0 |
| Ex. 50 | 0 | 0 | 0 | 0 | 0 | 0 | 0 | 0 | 0 |
| Ex. 51 | 0 | 0 | 0 | 0 | 0 | 0 | 0 | 0 | 0 |
| Ex. 52 | 0 | 0 | 0 | 0 | 0 | 0 | 0 | 0 | 0 |
| Ex. 53 | 0 | 0 | 2 | 0 | 0 | 0 | 0 | 0 | 1 |
| Ex. 54 | 0 | 0 | 1 | 0 | 0 | 2 | 0 | 0 | 1 |

TABLE 3

| | Blade dia. (mm) | Blade thickness (mm) | Rotational mode | Cutting mode | Rotational direction | Vc (m/min) | Vr (m/min) | V (m/min) |
|---|---|---|---|---|---|---|---|---|
| Comp. Ex. 1 | 60 | 0.5 | Free | Half-cut | — | 50 | — | — |
| Comp. Ex. 2 | 60 | 0.5 | Fixed | Half-cut | — | 50 | 0 | 50 |
| Comp. Ex. 3 | 60 | 0.5 | Fixed | Half-cut | — | 10 | 0 | 10 |
| Comp. Ex. 4 | 60 | 0.5 | Self-propelled | Half-cut | Forward | 50 | 10 | 40 |
| Comp. Ex. 5 | 60 | 0.5 | Self-propelled | Half-cut | Forward | 50 | 110 | −60 |
| Comp. Ex. 6 | 80 | 0.5 | Free | Half-cut | — | 50 | — | — |

TABLE 3-continued

| | | | | | | | | |
|---|---|---|---|---|---|---|---|---|
| Comp. Ex. 7 | 80 | 0.5 | Fixed | Half-cut | — | 50 | 0 | 50 |
| Comp. Ex. 8 | 80 | 0.5 | Fixed | Half-cut | — | 10 | 0 | 10 |
| Comp. Ex. 9 | 80 | 0.5 | Self-propelled | Half-cut | Forward | 50 | 10 | 40 |
| Comp. Ex. 10 | 80 | 0.5 | Self-propelled | Half-cut | Forward | 50 | 110 | −60 |
| Comp. Ex. 11 | 100 | 0.5 | Free | Half-cut | — | 50 | — | — |
| Comp. Ex. 12 | 100 | 0.5 | Fixed | Half-cut | — | 50 | 0 | 50 |
| Comp. Ex. 13 | 100 | 0.5 | Fixed | Half-cut | — | 10 | 0 | 10 |
| Comp. Ex. 14 | 100 | 0.5 | Self-propelled | Half-cut | Forward | 50 | 10 | 40 |
| Comp. Ex. 15 | 100 | 0.5 | Self-propelled | Half-cut | Forward | 50 | 110 | −60 |
| Comp. Ex. 16 | 80 | 0.2 | Free | Half-cut | — | 50 | — | — |
| Comp. Ex. 17 | 80 | 0.2 | Fixed | Half-cut | — | 50 | 0 | 50 |
| Comp. Ex. 18 | 80 | 0.2 | Fixed | Half-cut | — | 10 | 0 | 10 |
| Comp. Ex. 19 | 80 | 0.2 | Self-propelled | Half-cut | Forward | 50 | 10 | 40 |
| Comp. Ex. 20 | 80 | 0.2 | Self-propelled | Half-cut | Forward | 50 | 110 | −60 |
| Comp. Ex. 21 | 80 | 1 | Free | Half-cut | — | 50 | — | — |
| Comp. Ex. 22 | 80 | 1 | Fixed | Half-cut | — | 50 | 0 | 50 |
| Comp. Ex. 23 | 80 | 1 | Fixed | Half-cut | — | 10 | 0 | 10 |
| Comp. Ex. 24 | 80 | 1 | Self-propelled | Half-cut | Forward | 50 | 10 | 40 |
| Comp. Ex. 25 | 80 | 1 | Self-propelled | Half-cut | Forward | 50 | 110 | −60 |
| Comp. Ex. 26 | 80 | 0.5 | Free | Full-cut | — | 50 | | — |
| Comp. Ex. 27 | 80 | 0.5 | Fixed | Full-cut | — | 50 | 0 | 50 |
| Comp. Ex. 28 | 80 | 0.5 | Fixed | Full-cut | — | 10 | 0 | 10 |
| Comp. Ex. 29 | 80 | 0.5 | Self-propelled | Full-cut | Forward | 50 | 10 | 40 |
| Comp. Ex. 30 | 80 | 0.5 | Self-propelled | Full-cut | Forward | 50 | 110 | −60 |
| Comp. Ex. 31 | 80 | 0.5 | Self-propelled | Half-cut | Reverse | 50 | −10 | 60 |
| Comp. Ex. 32 | 80 | 0.5 | Self-propelled | Half-cut | Reverse | 50 | −20 | 70 |
| Comp. Ex. 33 | 80 | 0.5 | Self-propelled | Half-cut | Reverse | 50 | −30 | 80 |
| Comp. Ex. 34 | 80 | 0.5 | Self-propelled | Half-cut | Reverse | 50 | −40 | 90 |
| Comp. Ex. 35 | 80 | 0.5 | Self-propelled | Half-cut | Reverse | 50 | −50 | 100 |
| Comp. Ex. 36 | 80 | 0.5 | Self-propelled | Half-cut | Reverse | 50 | −60 | 110 |
| Comp. Ex. 37 | 80 | 0.5 | Self-propelled | Half-cut | Reverse | 50 | −70 | 120 |
| Comp. Ex. 38 | 80 | 0.5 | Self-propelled | Half-cut | Reverse | 50 | −80 | 130 |

| | Sample A | | | Sample B | | | Sample C | | |
|---|---|---|---|---|---|---|---|---|---|
| | Crack (piece) | Fray (piece) | Lifting (piece) | Crack (piece) | Fray (piece) | Lifting (piece) | Crack (piece) | Fray (piece) | Lifting (piece) |
| Comp. Ex. 1 | 0 | 4 | 0 | 2 | 5 | 0 | 10 | 4 | 0 |
| Comp. Ex. 2 | 0 | 0 | 10 | 0 | 0 | 10 | 0 | 0 | 10 |
| Comp. Ex. 3 | 0 | 0 | 10 | 0 | 0 | 10 | 0 | 0 | 10 |
| Comp. Ex. 4 | 0 | 3 | 10 | 0 | 1 | 10 | 0 | 2 | 10 |
| Comp. Ex. 5 | 0 | 2 | 10 | 0 | 1 | 10 | 0 | 1 | 10 |
| Comp. Ex. 6 | 0 | 4 | 0 | 3 | 4 | 0 | 10 | 5 | 0 |
| Comp. Ex. 7 | 0 | 0 | 10 | 0 | 0 | 10 | 0 | 0 | 10 |
| Comp. Ex. 8 | 0 | 0 | 10 | 0 | 0 | 10 | 0 | 0 | 10 |
| Comp. Ex. 9 | 0 | 3 | 10 | 0 | 3 | 10 | 0 | 2 | 10 |
| Comp. Ex. 10 | 0 | 2 | 10 | 0 | 1 | 10 | 0 | 2 | 10 |
| Comp. Ex. 11 | 0 | 3 | 0 | 2 | 4 | 0 | 10 | 5 | 0 |
| Comp. Ex. 12 | 0 | 0 | 10 | 0 | 0 | 10 | 0 | 0 | 10 |
| Comp. Ex. 13 | 0 | 0 | 10 | 0 | 0 | 10 | 0 | 0 | 10 |
| Comp. Ex. 14 | 0 | 2 | 10 | 0 | 2 | 10 | 0 | 3 | 10 |
| Comp. Ex. 15 | 0 | 2 | 10 | 0 | 1 | 10 | 0 | 1 | 10 |
| Comp. Ex. 16 | 0 | 2 | 0 | 1 | 2 | 0 | 10 | 2 | 0 |
| Comp. Ex. 17 | 0 | 0 | 10 | 0 | 0 | 10 | 0 | 0 | 10 |
| Comp. Ex. 18 | 0 | 0 | 10 | 0 | 0 | 10 | 0 | 0 | 10 |
| Comp. Ex. 19 | 0 | 2 | 10 | 0 | 3 | 10 | 0 | 3 | 10 |
| Comp. Ex. 20 | 0 | 3 | 10 | 0 | 4 | 10 | 0 | 3 | 10 |
| Comp. Ex. 21 | 0 | 6 | 0 | 8 | 5 | 0 | 10 | 4 | 0 |
| Comp. Ex. 22 | 0 | 0 | 10 | 0 | 0 | 10 | 0 | 0 | 10 |
| Comp. Ex. 23 | 0 | 0 | 10 | 0 | 0 | 10 | 0 | 0 | 10 |
| Comp. Ex. 24 | 0 | 2 | 10 | 0 | 4 | 10 | 0 | 4 | 10 |
| Comp. Ex. 25 | 0 | 3 | 10 | 0 | 3 | 10 | 0 | 2 | 10 |
| Comp. Ex. 26 | 0 | 5 | 0 | 4 | 6 | 0 | 10 | 6 | 0 |
| Comp. Ex. 27 | 0 | 0 | 10 | 0 | 0 | 10 | 0 | 0 | 10 |
| Comp. Ex. 28 | 0 | 0 | 10 | 0 | 0 | 10 | 0 | 0 | 10 |
| Comp. Ex. 29 | 0 | 2 | 10 | 0 | 3 | 10 | 0 | 3 | 10 |
| Comp. Ex. 30 | 0 | 2 | 10 | 0 | 2 | 10 | 0 | 1 | 10 |
| Comp. Ex. 31 | 0 | 2 | 10 | 0 | 2 | 10 | 0 | 2 | 10 |
| Comp. Ex. 32 | 0 | 1 | 10 | 0 | 2 | 10 | 0 | 1 | 10 |
| Comp. Ex. 33 | 0 | 0 | 10 | 0 | 0 | 10 | 0 | 0 | 10 |
| Comp. Ex. 34 | 0 | 0 | 10 | 0 | 0 | 10 | 0 | 0 | 10 |
| Comp. Ex. 35 | 0 | 0 | 10 | 0 | 0 | 10 | 0 | 0 | 10 |
| Comp. Ex. 36 | 0 | 0 | 10 | 0 | 0 | 10 | 0 | 0 | 10 |
| Comp. Ex. 37 | 0 | 0 | 10 | 0 | 0 | 10 | 0 | 0 | 10 |
| Comp. Ex. 38 | 0 | 0 | 10 | 0 | 0 | 10 | 0 | 0 | 10 |

According to the above results, there were no samples with crack and fray in the Examples. Lifting in a surface protection film did not occur, or even in the Examples with lifting caused, there were only three or less lifting portions.

Contrarily to this, either cracks, frays or lifting portions were caused in all the three kinds of Samples in the Comparative Examples, and it was found that the percentage defective in the Comparative Examples is much higher than that in the Examples.

From these results, it is found that the cutting method of the present invention can realize satisfactory cutting of a laminate film while preventing or reducing occurrence of cracks, lifting portions, or frays or rough cut edges.

DESCRIPTION OF THE REFERENCE NUMERALS

1: laminate film cutting apparatus, 10: cutting device, 11: circular cutter, 11*a*: blade, 13: rotating device, 14: moving device, 2: polarizing film (laminate film)

The invention claimed is:

1. A method of cutting a laminate film by a circular cutter having a blade which has a cutting edge in the form of a continuous circle around its peripheral edge portion, comprising rotating the circular cutter at a blade peripheral speed of Vr by a rotational device in a forward rotational direction relative to the cutting direction, while, at the same time, moving the circular cutter at a moving speed of Vc, thereby cutting the laminate film, wherein the relative cutting speed V calculated by subtracting the blade peripheral speed Vr from the moving speed Vc falls within a range of not less than −50 m/min to not more than 30 m/min, and the laminate film is cut by performing a half-cut method.

2. The method of cutting a laminate film according to claim 1, wherein the laminate film is a polarizing film including a polarizing layer and a release film layer laminated on at least one side of the polarizing layer via an adhesive layer.

3. A method of manufacturing an optical display device by cutting a laminate film and bonding the cut laminate film to an optical display unit, including a step of cutting a laminate film by the cutting method according to claim 1.

4. The method of cutting a laminate film according to claim 1, wherein the blade peripheral speed falls within a range of not less than 20 m/min to not more than 100 m/min.

5. A method of manufacturing an optical display device by cutting a laminate film and bonding the cut laminate film to an optical display unit, comprising a step of cutting a laminate film by the cutting method according to claim 4.

6. An apparatus for cutting a laminate film, comprising:

a cutting device that includes a circular cutter having a blade which has a cutting edge in the form of a continuous circle around its peripheral edge portion;

a rotational device that rotates the circular cutter at a blade peripheral speed of Vr in a forward rotational direction relative to the cutting direction;

a moving device that moves the circular cutter at a moving speed of Vc in the cutting direction; and a control device that controls the circular cutter so that the relative cutting speed V calculated by subtracting the blade peripheral speed Vr from the moving speed Vc, of the circular cutter, falls within a range of not less than −50 m/min to not more than 30 m/min, and the circular cutter is disposed to cut a laminate film by performing a half-cut method.

7. The apparatus for cutting a laminate film according to claim 6, wherein the blade peripheral speed falls within a range of not less than 20 m/min to not more than 100 m/min.

* * * * *